US006899387B2

(12) United States Patent
Ariizumi

(10) Patent No.: US 6,899,387 B2
(45) Date of Patent: May 31, 2005

(54) CUSHION

(75) Inventor: Katsumi Ariizumi, Chiyoda-Ku (JP)

(73) Assignee: Nissey Kougyo Corporation, Tokyo (JP)

( * ) Notice: Subject to any disclaimer, the term of this patent is extended or adjusted under 35 U.S.C. 154(b) by 0 days.

(21) Appl. No.: 10/740,366

(22) Filed: Dec. 18, 2003

(65) Prior Publication Data

US 2005/0012364 A1 Jan. 20, 2005

(30) Foreign Application Priority Data

Jul. 17, 2003 (JP) ..... 2003-270147

(51) Int. Cl.[7] ..... A63G 9/10; A47C 9/00; A47C 7/14

(52) U.S. Cl. ..... 297/181; 297/452.17; 297/461; 297/440.11; 5/911; 5/948

(58) Field of Search ..... 297/181, 461, 297/462, 440.1, 440.11, 452.17; 5/948, 911

(56) References Cited

U.S. PATENT DOCUMENTS

| | | | | | |
|---|---|---|---|---|---|
| 3,840,916 | A | * | 10/1974 | Jennings | 297/181 X |
| 3,965,506 | A | * | 6/1976 | Marks | 297/452.17 |
| 4,347,213 | A | * | 8/1982 | Rogers, Jr. | 264/510 |
| 4,875,732 | A | * | 10/1989 | Miller | 297/181 |
| 5,364,161 | A | * | 11/1994 | Liu | 297/181 X |
| 5,733,012 | A | * | 3/1998 | Jones | 297/452.17 |
| 5,765,502 | A | * | 6/1998 | Haugh | 5/722 X |
| 5,778,470 | A | * | 7/1998 | Haider | 5/911 X |
| 5,839,138 | A | * | 11/1998 | Weidman et al. | 5/636 |
| 5,941,599 | A | * | 8/1999 | Roberts | 297/181 X |
| 6,049,929 | A | * | 4/2000 | Rawson | 297/181 X |
| 6,141,807 | A | * | 11/2000 | Tapper | 5/653 |
| 6,209,962 | B1 | * | 4/2001 | Sobel et al. | 297/452.17 |
| 6,234,577 | B1 | * | 5/2001 | Ruppert et al. | 297/452.17 |
| 6,494,532 | B1 | * | 12/2002 | Brosnan et al. | 297/181 |
| 2002/0023299 | A1 | * | 2/2002 | George | 5/652 |
| 2002/0101099 | A1 | * | 8/2002 | Hughes | 297/181 |
| 2002/0104166 | A1 | * | 8/2002 | Mangiaracina | 297/181 X |
| 2004/0019972 | A1 | * | 2/2004 | Schecter et al. | 5/645 |

FOREIGN PATENT DOCUMENTS

| | | | |
|---|---|---|---|
| GB | 2156208 | A * | 10/1985 |
| GB | 2181948 | A * | 5/1987 |
| JP | 3022218 | | 3/1996 |
| JP | 3081750 | | 11/2001 |
| JP | 2003-093260 | | 4/2003 |
| JP | 2003-135191 | | 6/2003 |

* cited by examiner

*Primary Examiner*—Rodney B. White
(74) *Attorney, Agent, or Firm*—Burr & Brown

(57) ABSTRACT

An entertaining cushion is provided, wherein the user can change the shape and visually enjoy such shape changes. The cushion includes an outer cover member formed by integrally combining a plurality of individual bag members that have different shapes such that the respective interiors of the bag members are in fluid communication with each other and a particulate filling material provided in the outer cover member that is capable of changing the appearance of the outer cover member by moving between and among the interiors of the bag members. Beads are used as the filling material.

8 Claims, 4 Drawing Sheets

CUSHION

This application claims the benefit of Japanese Application 2003-270147, filed Jul. 17, 2003, the entirety of which is incorporated herein by reference.

BACKGROUND OF THE INVENTION

1. Field of the Invention

The present invention relates to a cushion.

2. Description of the Related Art

In the related art, a cushion in which beads are stored as a filling material in an outer cover member exists. Such a cushion has the property whereby the shape can be changed in accordance with a physique due to a preferable flow property of the beads.

The cushion described above, however, is formed into a square, a spherical, or a disk shape, and can change its shape simply in accordance with the physique. Such a change in the shape of the cushion is intended only to achieve a practical object, such as to conform to the physique. Therefore, the change in the shape of the cushion does not provide entertainment for users.

SUMMARY OF THE INVENTION

Accordingly, it is an object of the present invention to provide an entertaining cushion wherein the user can change the shape and visually enjoy such a change in shape when in use.

In order to achieve the object described above, a cushion according to the present invention includes an outer cover member formed by integrally combining a plurality of discrete bag members being different in shape from each other and being in fluid communication with each other in interiors thereof, and a filling material in the shape of particulates stored in the outer cover member and that is capable of changing the appearance of the outer cover member by moving among the bag members.

Accordingly, with the cushion according to the present invention, the shape of the appearance of the outer cover member may be changed by moving the particulate filling material stored therein between the respective bag members, and thus, variations in shape thereof can be visually enjoyed.

The cushion according to the present invention can be formed in such a manner that one of the bag members of the outer cover member can be stored in the other bag member thereof.

Accordingly, when the cushion of the present invention includes one bag member stored in the other bag member, the outer cover member can be changed into another completely different appearance having two different shaped parts by pulling the one bag member out from the other bag member, so that it gives a strong impression to the user with an element of surprise, and thus, the user can have more fun.

In addition, by storing the one bag member in the other bag member, it can be stored in a compact shape.

The cushion according to the present invention may be formed in such a manner that the shape of the one bag member of the outer cover member relates to the shape of the other bag member thereof. Consequently, since the shapes of the bag members have relevance with respect to each other, a story-like property is imparted to the cushion of the present invention, and thus, the imagination of the user is stimulated, and the user may have much more fun.

The cushion of the present invention may include beads as the filling material. Accordingly, in the cushion of the present invention, extremely desirable usability is achieved, since the shape can be changed smoothly due to the desirable flow property of the beads, the cushion has superior resiliency, and a soft feel.

According to the cushion of the present invention, the shape of the outer cover member may be changed by moving the particulate filling material stored therein between the bag members, and thus, variations of the shape may be visually enjoyed. Therefore, the cushion can be used for pleasure, and is thus specifically appreciated by children.

DETAILED DESCRIPTION OF THE INVENTION

Referring now to the attached drawings, an embodiment of the present invention will be described.

Figure 1:
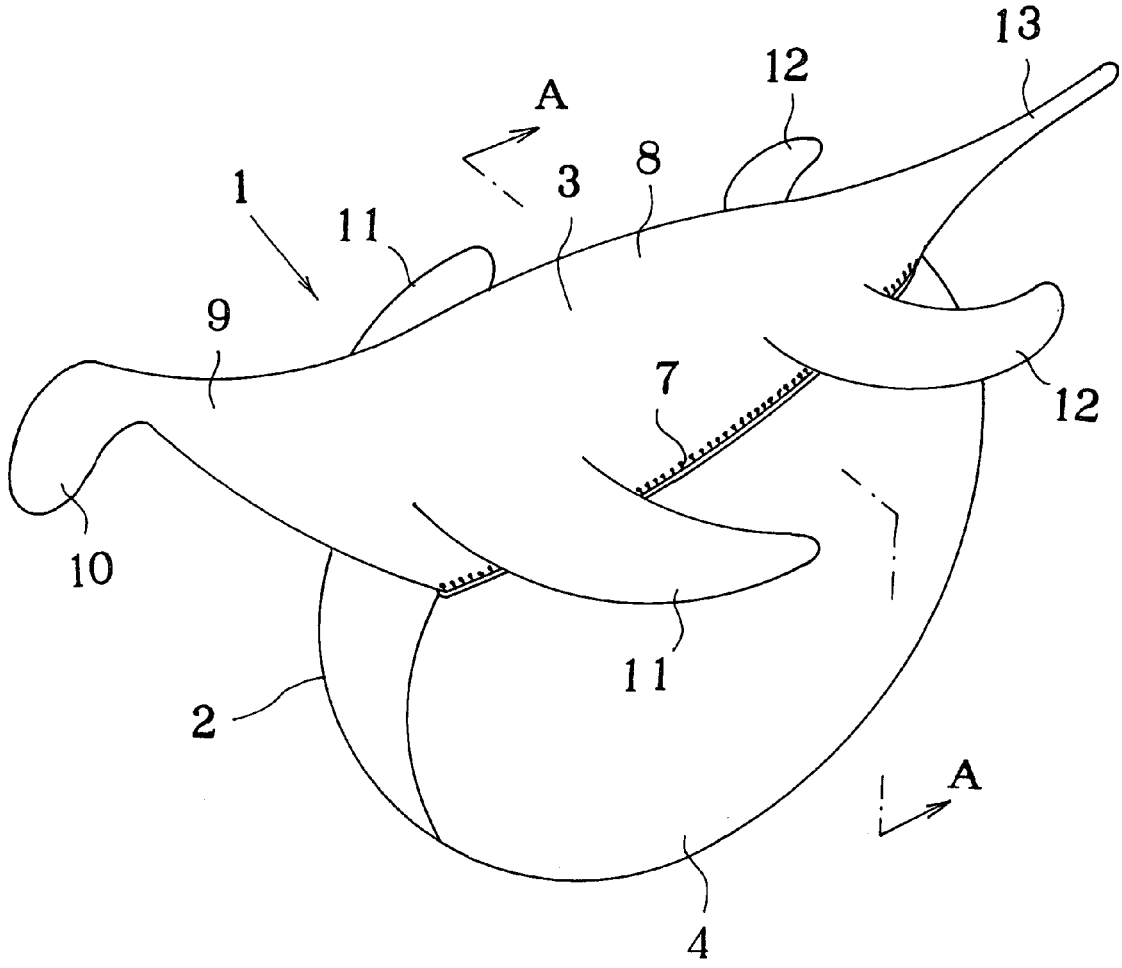
FIG. 1 is a perspective view of the an embodiment of a cushion according to the present invention, showing a state in which one bag member is projected outward from the other back portion.
Figure 2:
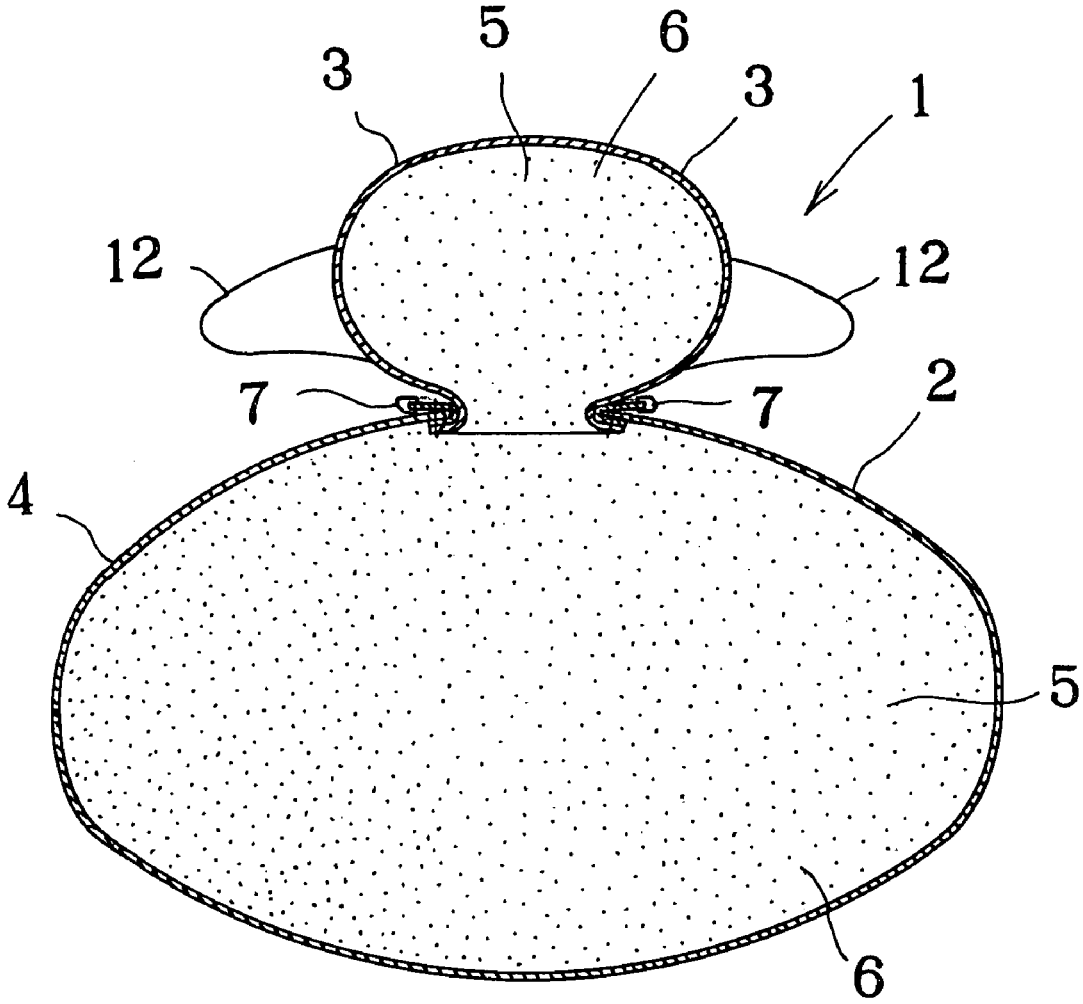
FIG. 2 is a cross-sectional view taken along the line A—A in FIG. 1.

As shown in FIGS. 1 and 2, a cushion 1 according to the present embodiment includes an outer cover member 2 formed by integrally combining a plurality of bag members 3 and 4 that have a different shape from each other such that the interiors thereof are in fluid communication with each other. A particulate filling material 5 is provided in the interior of the outer cover member 2 and is capable of changing the appearance of the outer cover member 2 by internally moving between the bag members 3 and 4.

Figure 3:
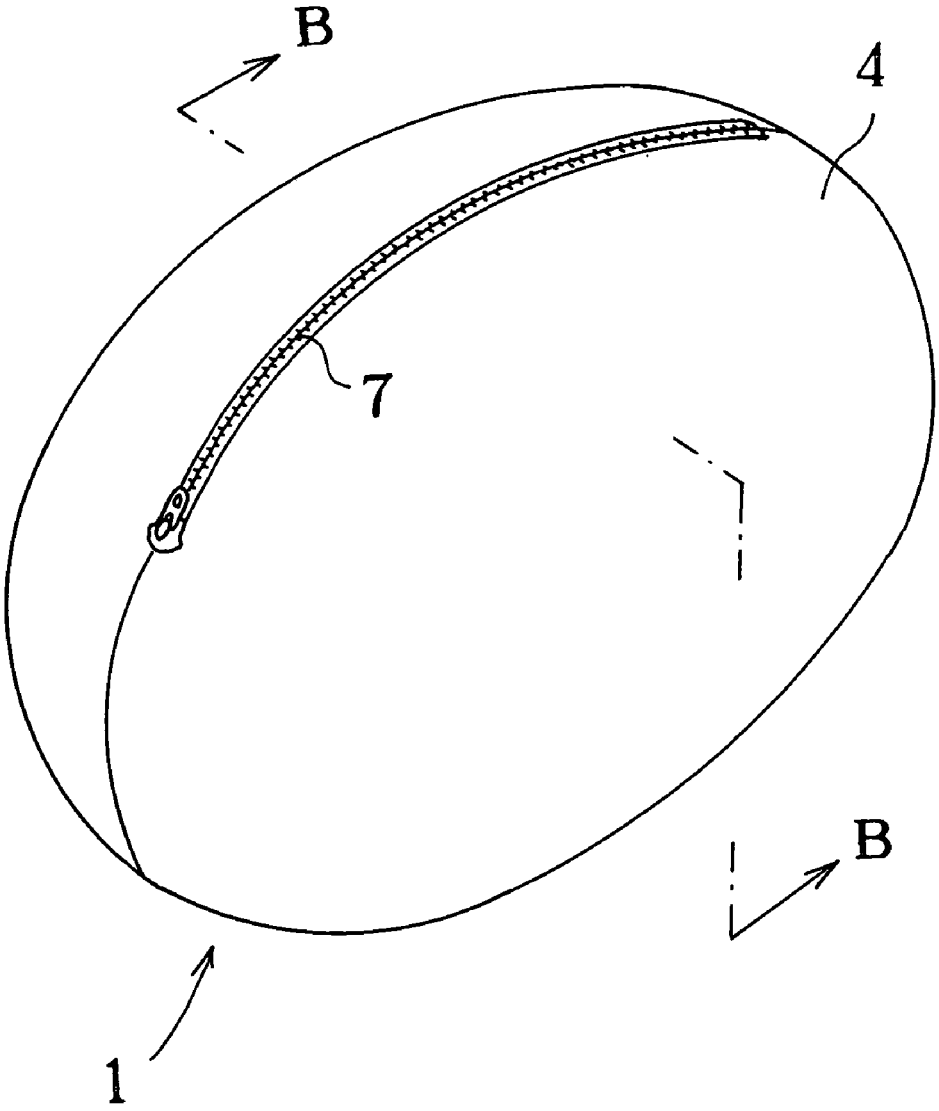
FIG. 3 is a perspective view showing a state in which the one bag member is stored in the other bag member.
Figure 4:
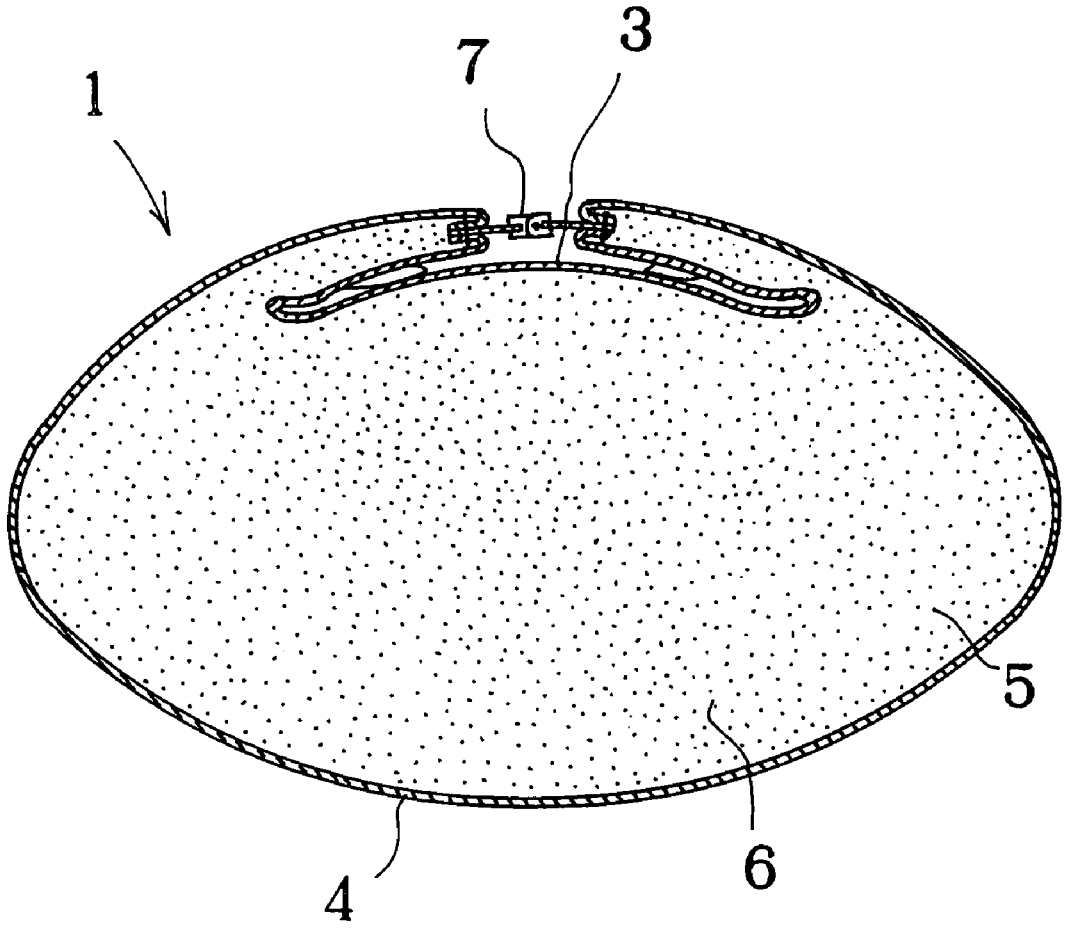
FIG. 4 is a cross-sectional view taken along the line B—B in FIG. 3.

As shown in FIGS. 3 and 4, the first bag member 3 is formed into a shape that can be stored in the second bag member 4 of the cover member 2. As shown in FIG. 1, the first bag member 3 and the second bag member 4 of the outer cover member 2 are formed to have shapes that are relevant to each other. As shown in FIGS. 2 and 4, beads 6 are employed as the filling material 5.

The embodiment shown in the drawings will be described below. According to the cushion 1 of the present embodiment, as shown in FIGS. 1 and 2, the two bag members 3 and 4 are integrally combined to form the outer cover member 2. It should be noted that the number of bag members may be increased to three or more.

The respective bag members 3 and 4 of the outer cover member 2 are, as shown in FIG. 2, formed so that the interiors thereof are in fluid communication with each other. In other words, as shown in FIG. 2, the peripheral edge of the opening of the first bag portion 3 and the peripheral edge of the opening of the second bag member 4 are connected so that the interior of the first bag member 3 and the interior of the second bag member 4 communicate with each other.

As shown in FIG. 2, the filling material 5 is provided in the outer cover member 2. Since the interiors of the respective bag members 3 and 4 are in fluid communication with each other as described above, the filling material 5 can move between the bag members 3 and 4. In other words, the filling material 5 can move from the first bag member 3 to the second bag member 4, and vice versa.

As shown in FIG. 1, the two bag members 3 and 4 have different shapes from each other and are respectively formed into shapes that are related to each other. In other words, according to the embodiment shown in FIG. 1, the first bag member 3 is formed into a shape of a dinosaur baby, that is, a dinosaur shape including a body portion 8, a neck portion 9 projecting from the front end of the body portion 8 obliquely upward, a head portion 10 formed at the distal end of the neck portion 9, left and right front leg portions 11 projecting sidewardly from the lower portion of the front end of the body portion 8, left and right leg portions 12 projecting sideward from the lower portion of the rear end of the body portion 8, and a tail portion 13 projecting rearward from the center of the rear end of the body portion 8. The second bag member 4 is formed as an egg shape, that is, the shape of a dinosaur egg from which the dinosaur baby (first bag member 3) is hatched, as shown in FIG. 1.

The shapes of the bag members 3 and 4 may be determined at liberty and are not limited to the dinosaur baby and the dinosaur egg examples shown here.

The first bag member 3 of the outer cover member 2 is formed such that it is capable of being stored in the second bag member 4, as shown in FIGS. 3 and 4. In other words, as shown in FIG. 4, the first bag member is formed in such a manner that the first bag member 3, having the shape of the dinosaur baby, may be stored in the interior of the second bag member 4, having the shape of the dinosaur egg. At this time, the first bag member 3, having the shape of the dinosaur baby, is changed to be inside out, as shown in FIG. 4, and the filling material 5 provided in the first bag member 3 completely moves to the second bag member 4.

Then, as shown in FIGS. 3 and 4, a sliding fastener 7 is attached to the peripheral edge of the opening of the second bag member 4, so that the opening of the second bag member 4, shaped like the dinosaur egg, can be closed such that the first bag member 3, shaped like the dinosaur baby, is stored in the interior of the second bag member 4, shaped like the dinosaur egg. Therefore, by closing the sliding fastener 7 such that the first bag member 3, shaped like the dinosaur baby, is stored in the interior of the second bag member 4, shaped like the dinosaur egg, as shown in FIG. 3, only the shape of the second bag member 4, shaped like the dinosaur egg, is exposed.

Then, in order to expose the first bag member 3, shaped like the dinosaur baby, the sliding fastener 7 is opened, the opening of the second bag member 4, shaped like the dinosaur egg, is opened, and the first bag member 3, shaped like the dinosaur baby, is pulled outward from inside the second bag member 4.

At this time, a story that the dinosaur baby is just hatched from the egg is created. Therefore, the user may have fin to use their imagination in accordance with the story.

A cloth material having a soft feel and a pleasant texture is preferably used as the material of the outer cover member 2.

In order to enable movement of the filling material 5 between the bag members 3 and 4, some amount of air space is provided in the outer cover member 2. Therefore, the amount of filling material 5 stored in the outer cover member 2 less than the amount that would completely fill each of the bag members 3 and 4, so as to provide space in one of the bag members 3 and 4, even when the other bag member is completely filled with the filling material 5.

Although it is shown as if both of the bag members 3 and 4 are filled completely with the filling material 5 in FIG. 2, it is to be understood that space is provided in the portion that cannot be seen in the drawing.

Beads 6 are used as the filling material 5 provided in the outer cover member 2. The beads 6 are fine particulate substances, and the size of those used in this example are in a range of about 0.5 to 1 mm in particle diameter. The beads 6 may be made of any material, and a polyolefin-based synthetic resin, such as polypropylene or polyethylene, and a thermoplastic synthetic resin, such as polystyrene and polyvinyl chloride, may be used. It is also possible to use beads that are formed from an expanded synthetic resin, such as so-called expanded beads, for example, and expanded polystyrene beads. In other words, the filler material may be selected arbitrarily from these materials.

The features described in the above-described embodiment may be modified as needed within the scope of the present invention.

What is claimed is:

1. A cushion comprising:

an outer cover member comprising an integrated plurality of individual bag members, each said bag member having a different shape, said bag members being integrated such that respective interior portions of each said bag member are in fluid communication with each other to define an internal portion of said outer cover member; and a particulate filling material provided directly within said internal portion of said outer cover member that is capable of changing the appearance of said outer cover member by moving among and between said interior portions of said bag members within said internal portion of said outer cover member.

2. The cushion according to claim 1, wherein at least one of said bag members has a shape that is capable of being stored within said internal portion of said outer cover.

3. The cushion according to claim 1, wherein each different shape of each said bag member has a related conceptual relevance with respect to one another.

4. The cushion according to claim 1, wherein said filling material comprises beads.

5. An entertainment cushion comprising:

at least a first discrete portion having a first shape and at least a second discrete portion having a second shape that is different from said first shape, said first and second discrete portions being integrated to define an outer surface, an inner surface and an enclosed interior space, said interior space comprising at least a first portion corresponding to said first shape and at least a second portion corresponding to said second shape that is integrated with said first portion such that said first and second portions of said interior space are in fluid communication with one another; and a particulate filling material provided directly within said interior space that is capable of translocating between said first and second portions of said interior space to change the overall appearance of said first and second shapes of said outer surface.

6. The entertainment cushion of claim 5, wherein at least one of said first shape and said second shape is capable of assuming another shape that is capable of residing within the other of said first and said second portions of said interior space when said filling material translocates between said first and said second portions of said interior space.

7. The entertainment cushion of claim 5, wherein said first shape and said second shape are conceptually related to each other in a manner that transcends physical functionality and ordinary geometric relationships.

8. The entertainment cushion of claim 5, wherein said particulate filling material comprises beads.

* * * * *